US006415497B1

(12) United States Patent
Seok et al.

(10) Patent No.: US 6,415,497 B1
(45) Date of Patent: Jul. 9, 2002

(54) METHOD FOR MANUFACTURING A TUBE-TYPE SPRAY FORMED PRODUCT

(75) Inventors: Hyun Kwang Seok; Jae Chul Lee; Byung Jo Kim; Don Soo Shin; Ho-In Lee, all of Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 20 days.

(21) Appl. No.: 09/641,079

(22) Filed: Aug. 17, 2000

(30) Foreign Application Priority Data

Jan. 10, 2000 (KR) ..... 00/884

(51) Int. Cl.[7] ..... B21B 1/46
(52) U.S. Cl. ..... 29/527.1; 164/46
(58) Field of Search ..... 29/527.1, 527.2; 164/46

(56) References Cited

FOREIGN PATENT DOCUMENTS

EP 0 404 274 A1 12/1990

OTHER PUBLICATIONS

P.F. Chesney and J.J. Mascolino, Markets and Opportunities for Tubular and Bimetallic Spray Formed Products, Powder Metallurgy, No. 1., vol. 40, 1997, pp. 31–33.

P.S. Grant, Spray Forming, Progress in Material Scinece, vol. 39, pp. 497–545, 1995.

*Primary Examiner*—P. W. Echols
(74) *Attorney, Agent, or Firm*—Darby & Darby

(57) ABSTRACT

The present invention relates to a method for manufacturing a tube-type spray formed product and, in particular, to a method for manufacturing a tube-type spray formed product without using a core. The present invention provides a method for manufacturing a tube-type spray formed product in which a tube-type spray formed product is formed by spraying droplets through an atomizer installed at the position separated from the center portion of a rotating plate as much as the droplets should not sprayed on the center portion of the rotating plate.

10 Claims, 5 Drawing Sheets

Manufacturing of bar-type spray formed product tube extrusion

Billet Machining ring forging ring

METHOD FOR MANUFACTURING A TUBE-TYPE SPRAY FORMED PRODUCT

BACKGROUND OF THE INVENTION

1. Field of the Invention

The present invention relates to a method for manufacturing a tube-type spray formed product and, in particular, to a method for manufacturing a tube-type spray formed product without using a core.

2. Description of the Background Art

In the conventional art for manufacturing a tube-type formed product using a spray forming method, the method of spraying droplets on a core has been used. Thus, there is an inconvenience in that the core and the tube-type formed product must be separated, in a case where only the tube-type formed product is desired to be used. In addition, there is a problem that a separate apparatus for manufacturing each tube-type formed product, that is, a particular core is required. This increases the unit cost of production and requires additional time and labor. Besides, there is a problem that it is not easy to release heat in a process of manufacturing a tube-type spray formed product to obtain a formed product with a uniform microstructure.

Currently, a seamless tube or a forged ring is manufactured by a continuous process where a billet manufactured by a casting or spray forming method is cut and internally machined and then tube-extruded or ring-forged. In this case, there is a disadvantage that additional time and labor is required for internally machining the billet and a loss of material occurs.

Hereinafter, the conventional art is described with reference to the accompanying drawings.

FIG. 1 is a schematic view illustrating a conventional spray forming method. As illustrated therein, this method is achieved in such a manner that molten metal is sprayed using a high pressure gas, and the droplets 2 of the spray move toward a plate while in an incompletely solidified state. The droplets are completely solidified only after they reach the plate, thereby forming a formed product 1, By using this method, a piece of metal material can be manufactured at a cooling rate of $10^3$–$10^5$ K/sec. A bar-type or plate-type formed product can be directly manufactured according to the spray process and relative movement of a plate and an atomizer, so that the forming process can be shortened. Therefore, this manufacturing method can be applied to the quick solidification of commercial alloys, as well as the formation of metal material that are otherwise difficult to process, so that an interest is awakened in a new manufacturing method. Reference numerals 3, 4 and 5 in FIG. 1 illustrate a tundish, an atomizer and a molten metal, respectively.

FIG. 2 is a schematic view illustrating a method for manufacturing a conventional tube-type spray formed product. As illustrated therein, the product is manufactured by spraying droplets on a rotating member, shows as a core 6, by an atomizer. In this process, the core is disposable or semi-permanent. Currently, a stainless tube with a large diameter and a relatively small thickness is manufactured by this method. In addition, this method is applied to manufacturing in which the core material and formed product material are different from each other. However, as described above, there is an inconvenience in that the core 6 and the tube-type formed product 1 must be separated in order to produce only the tube-type formed product. Moreover, there is a problem that a separate member, that is, the core 6, for manufacturing each tube-type formed product 1 is additionally required, thereby increasing the unit cost of production and demanding additional time and labor in the manufacturing process.

FIG. 3 is a schematic view illustrating a conventional tube extrusion process, and FIG. 4 is a schematic view illustrating a conventional ring forging process. As illustrated therein, currently, a seamless tube or forged ring is manufactured by a continuous process where a billet manufactured by a casting or spray forming method is cut, internally machined, and then the tube is extruded or ring-forged. In this case, there is a disadvantage that a material loss occurs due to the machining of the interior of the billet, an also increasing the time taken for the process.

SUMMARY OF THE INVENTION

The present invention is directed to solve the above problems, and it is hence an object thereof to manufacture a tube-type spray formed product by directly using a conventional apparatus rather than using a separate apparatus. Accordingly, the invention reduces the additional costs incurred by the use of an additional apparatus and various forms of spray formed products can be obtained in the same manufacturing line.

In addition, it is another object of the present invention to provide a method for manufacturing a spray formed product capable of solving the above problems occurred due to the use of a core. That is, a spray formed product can be formed using the invention while reducing additional time and labor in a plan process and avoiding the inconvenience that the core and the formed product must be separated.

In addition, it is still another object of the present invention to obtain a tube-type spray formed product having a uniform microstructure by providing a process of manufacturing a tube-type spray formed product with excellent heat release characteristics.

In addition, it is yet still another object of the present invention to provide a method for manufacturing a tube-type spray formed product having a simple manufacturing process that does not have material loss, and which method is usable with a later applied tube extrusion or ring forging process.

In order to achieve the above objects, there is provided a method for manufacturing a tube-type spray formed product by spraying droplets from an atomizer that is installed at a position separated from the center of a rotating plate that is positioned so that droplets should not be sprayed on the center portion of the rotating plate. Accordingly, a tube-type spray formed product can be formed by using a conventional spray forming apparatus for manufacturing a bar-type formed product, without using a separate apparatus, for example, a core.

In accordance with a preferred embodiment of the present invention, the tube-type spray formed product is further subjected to a tube extrusion process or a ring forging process. By these two additional processes, the internal porosity of the formed product is reduced, the strength is increased, the structure is finished, and thereby it is possible to provide a tube or a ring with excellent mechanical properties.

In accordance with another embodiment of the present invention, a vibratory atomizer can be used, or a plurality of atomizers installed at different positions can be used in order for the diameter, thickness and forming speed of the tube-type spray formed product to meet the design objective.

The rotating plate in accordance with the present invention can move in the direction of the plate axis of rotation.

Additional advantages, objects and features of the invention will become more apparent from the description which follows.

BRIEF DESCRIPTION OF THE DRAWINGS

The present invention will become better understood with reference to the accompanying drawings which are given only by way of illustration and thus are not imitative of the present invention, wherein:

FIG. 6*b* illustrates a method for spraying in different directions using two atomizers, and FIG. 6*c* illustrates a method for spraying in the same direction using two atomizers;

DETAILED DESCRIPTION OF THE PREFERRED EMBODIMENTS

The preferred embodiments of the present invention will now be described with reference to the accompanying drawings.

Figure 1:
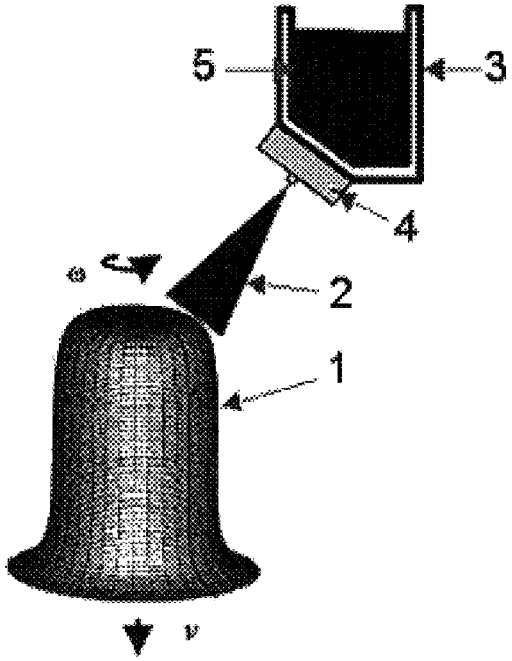
FIG. 1 PRIOR ART
FIG. 1 is schematic view explaining a conventional spray forming method.
Figure 2:
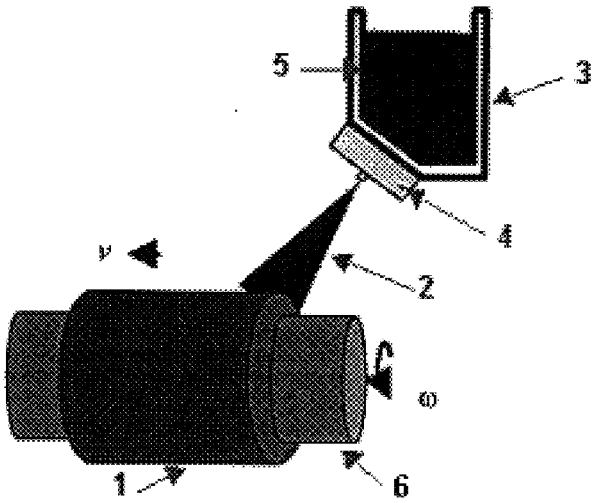
FIG. 2 PRIOR ART
FIG. 2 is a schematic view illustrating a conventional method for manufacturing a tube-type spray formed product.
Figure 3:
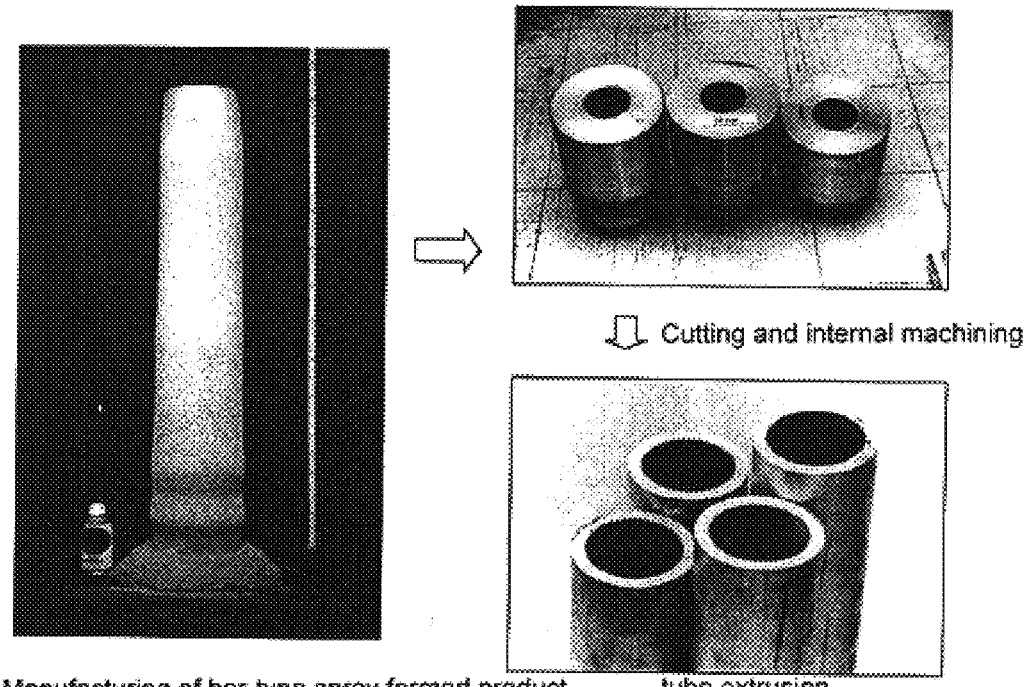
FIG. 3 PRIOR ART
FIG. 3 is a schematic view illustrating a conventional tube extrusion process.
Figure 4:
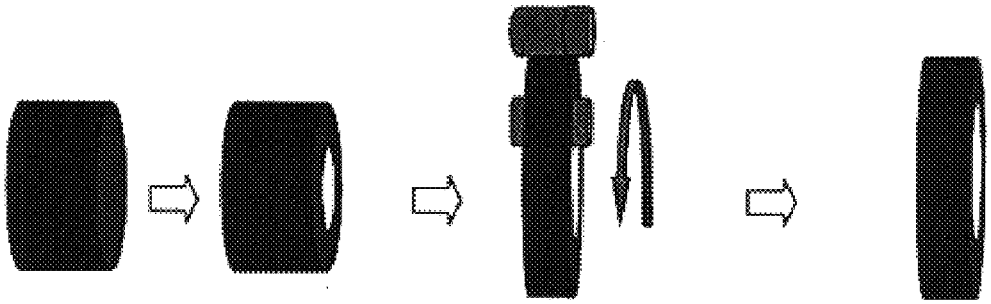
FIG. 4 PRIOR ART
FIG. 4 is a schematic view illustrating conventional ring forging process.
Figure 5:
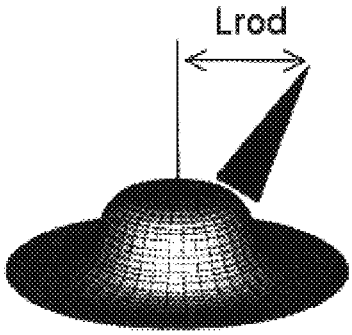
FIG. 5 PRIOR ART
FIG. 5 is a schematic view illustrating a conventional method for manufacturing a bar-type formed product, in particular, the position of a plate and an atomizer in the manufacturing process.

FIG. 5 is a schematic view illustrating a conventional method for manufacturing a bar-type formed product showing the positions of a plate and an atomizer. Lrod represents the horizontal distance from the central axis of the plate to the atomizer.

Figure 6A:
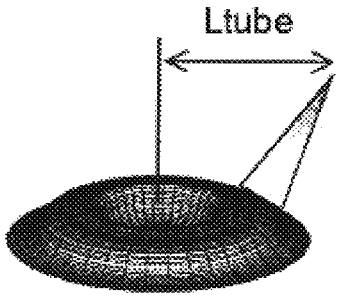
FIGS. 6*a* through 6*c* are schematic views illustrating a method for manufacturing a tube-type spray formed product in accordance with the present invention, in particular.
Figure 6B:
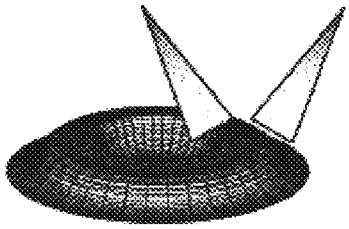
Figure 6C:
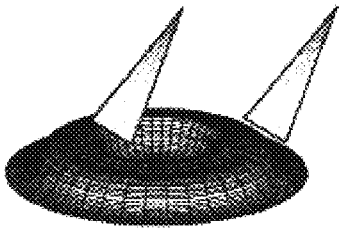

FIGS. 6*a* through 6*c* are schematic views of a method for manufacturing a spray formed product in accordance with the present invention that includes a plate P that is rotated about its center axis and an atomizer A that produces a spray S of molten metal droplets. To manufacture a tube-type spray formed product without using a core plate, the atomizer A must be located at a position far enough from the center portion of the rotating plate P. That is, the horizontal distance from the central axis of the rotating plate to the atomizer is Ltube, Ltube must be larger than Lrod. The value of Ltube varies according to the diameter of the tube-type formed product. However, in order to manufacture a tube-type spray formed product with its center being hollow, the spray from the atomizer must be separated from the center of the rotating plate P so that droplets should not be sprayed on the center portion of the rotating plate, considering that Lrod is usually 200–300 mm, Ltube is preferably larger than Lrod.

In accordance with the tube-type spray forming method of the present invention, unlike the conventional method for manufacturing a tube-type spray formed product, it is possible to release heat through the center portion of the formed product because the center portion is hollow, whereby a tube-type spray formed product with a uniform microstructure is provided.

In order to control the diameter, thickness and forming speed of the tube-type formed product, the atomizer A can be vibrated within a certain range, or two or more atomizers can be used. FIG. 6*b* illustrates a method for spraying using two atomizers A1 and A2 spraying in different directions, and FIG. 6*c* illustrates a method with two atomizers A1 and A2 spraying in the same direction.

Figure 7:
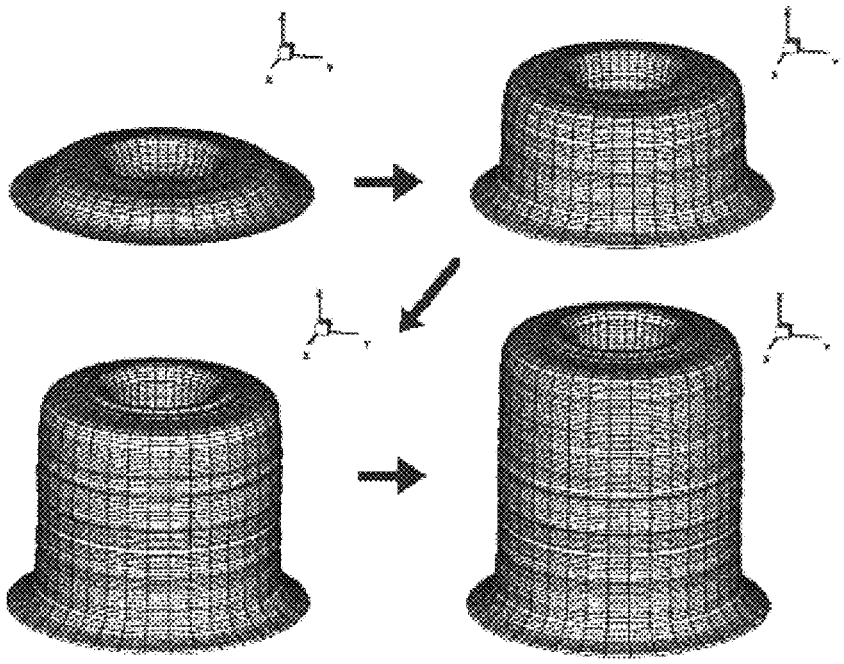
FIG. 7 is a view illustrating changes in the form of a tube-type spray formed product manufactured by a method for manufacturing a tube-type spray formed product in accordance with the present invention.

In accordance with the first embodiment of the present invention, the rotating plate can move in the rotating axial direction in order to manufacture a large length formed product, as shown in FIG. 7, which is a view illustrating a procedure of changes in the form of a tube-type spray formed product manufactured by the tube-type spray forming method in accordance with the present invention.

Figure 8:
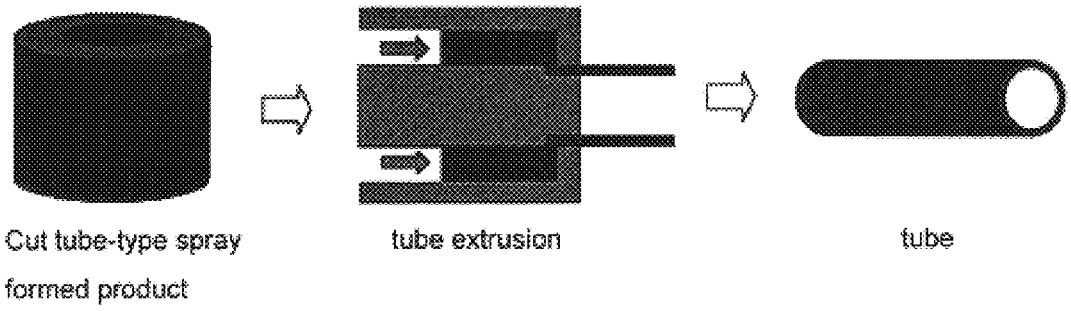
FIG. 8 is a view illustrating a tube extrusion of a tube-type spray formed product in accordance with the present invention.

FIG. 8 is a view illustrating a tube extrusion of a tube-type spray formed product in accordance with the present invention. As illustrated therein, the manufactured tube-type spray formed product is cut at a certain length, and then extruded.

Figure 9:
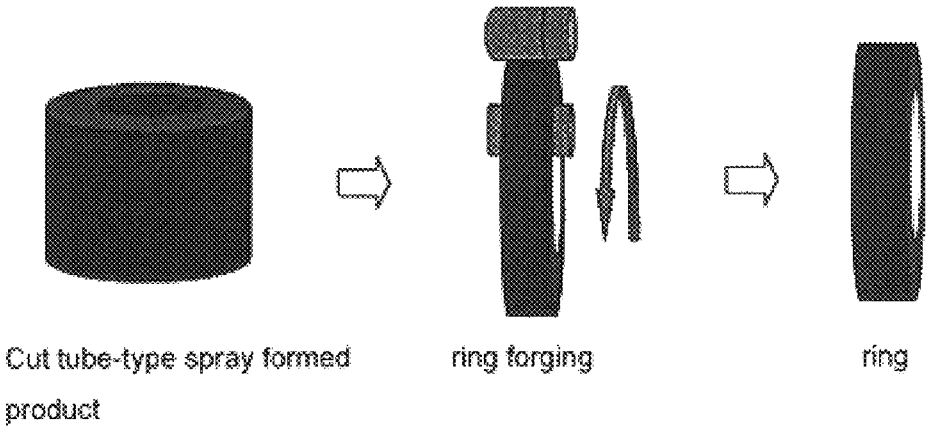
FIG. 9 is a view illustrating a ring forging process of a tube-type spray formed product in accordance with the present invention.

FIG. 9 is a view illustrating a ring forging process of a tube-type spray formed product in accordance with the present invention. As illustrated therein, the manufacture tube-type spray formed product is cut at a certain length, and then ring-forged.

Through a post-treatment process including tube extrusion and ring forging of a tube-type formed product in accordance with the present invention, the internal porosity of the formed product is reduced, the strength is increased, the structure is finished and thereby it is possible to provide a tube or a ring with excellent mechanical properties.

In accordance with the present invention thus described, a tube-type spray formed product can be manufactured by directly using a conventional apparatus for manufacturing a spray formed product, rather than using separate pieces of apparatus. Accordingly, the spray forming apparatus has advantages in that additional costs according to the employing of an additional piece of apparatus can be reduced. Also, various forms of spray formed products can be obtained in the same manufacturing line.

In addition, the method of the invention for manufacturing a spray formed product is capable of reducing time and labor in a plan process and avoids the inconvenience that the core and the formed product must be separated.

In addition, the invention produces a tube-type spray formed product with a uniform microstructure and that has excellent heat release characteristics.

In addition, the method of the invention for manufacturing tube-type spray formed product is a simple manufacturing process, does not have material loss, and can be directly connected with a tube extrusion or ring forging process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore, all changes and modifications that fall within the meets and bounds of the claims, or equivalences of such meets and bounds, are therefore intended to be embraced by the appended claims.

What is claimed is:

1. A method of forming an annular object comprising:

rotating a plate having a center and an edge portion;

pointing an atomizer towards a position on the rotating plate between the center and the edge portion of the plate for forming an annular object on top of the plate;

spraying a material from the atomizer towards the plate to aggregate the material on the rotating plate, thereby forming an annular object on top of the plate in accordance with the spraying; and moving the plate and/or the atomizer in a direction transverse to the top of the plate as the spraying of material takes place.

2. The method of claim 1, further comprising subjecting the formed annular object to a tube extrusion process or a ring forging process.

3. The method of claim 2, wherein the atomizer is a vibratory atomizer, and the rotating plate is moved in the direction of the rotation axis of the plate.

4. The method of claim 1, wherein a plurality of atomizers located at different positions are used.

5. The method of claim 4, wherein the rotating plate is moved in the direction of the rotation axis of the plate.

6. The method of claim 1, wherein the rotating plate is moved in the direction of the rotation axis of the plate.

7. The method of claim 1, wherein the atomizer is a vibratory atomizer, and the rotating plate is moved in the direction of the rotation axis of the plate.

8. The method as claimed in claim 1 wherein the material sprayed is molten metal.

9. A method of forming an annular object comprising:

providing a plate having a center and an edge portion;

pointing an atomizer towards a position on the plate between the center and the edge portion of the plate for forming an annular object on the surface of the plate;

rotating the pointed atomizer above the plate;

spraying a material from the rotating pointed atomizer towards the plate to aggregate the material on the plate while moving the plate and/or the atomizer in a direction transverse to the surface of the rotating plate, and forming the annular object on the plate surface in accordance with the spraying.

10. The method as claimed in claim 9 wherein the material sprayed is molten metal.

* * * * *